US005143404A

United States Patent [19]

Flowers, Jr.

[11] Patent Number: 5,143,404

[45] Date of Patent: Sep. 1, 1992

[54] NOTE PAD

[76] Inventor: Richard G. Flowers, Jr., 15715 Lone Tree, Houston, Tex. 77084

[21] Appl. No.: 701,201

[22] Filed: May 16, 1991

[51] Int. Cl.[5] ..... B42D 1/00

[52] U.S. Cl. ..... 231/21.1; 281/31; 283/56; 412/2

[58] Field of Search ..... 281/15.1, 21.1, 31; 283/56; 412/2

[56] References Cited

U.S. PATENT DOCUMENTS

| | | | |
|---|---|---|---|
| 167,045 | 8/1875 | Wilkerson | 283/56 |
| 537,431 | 4/1989 | Anderson . | |
| 790,522 | 5/1905 | Óváry | 283/56 |
| 1,219,589 | 3/1917 | Schaeffer | 412/2 |
| 1,634,712 | 7/1927 | Friedman . | |
| 2,755,576 | 7/1956 | Golden | 40/10 |
| 2,797,509 | 7/1957 | Golden | 40/10 |
| 4,395,056 | 7/1983 | Sferragatta | 281/31 |
| 4,566,721 | 1/1986 | Friedman et al. | 251/31 |
| 4,957,311 | 9/1990 | Geisenheimer | 253/56 |

*Primary Examiner*—Paul A. Bell

[57] ABSTRACT

An improved note pad having a stack of paper sheets with an advertising structure bound on the top surface thereof in such a manner that such structure may be folded back away from the top sheet to allow all of the sheet to be used and to expose a message on the underside of the structure. In one form of the invention a business card is used as the advertising structure and is bound to the pad face down on the top sheet and foldable away therefrom. In another form of the invention a telephone directory card is bound into the pad on top of the stack. In still another form of the invention a transparent pocket, such as a card case, is bound to the pad as the advertising structure and one or more business cards or other advertising cards may be inserted into the pocket which may be visible and read on both sides of the pocket.

6 Claims, 2 Drawing Sheets

NOTE PAD

BACKGROUND

The present invention relates to an improved note pad and its binding which includes a card for advertising bound to the pad to allow easy removal of the individual sheets without the removal of the advertising card.

U.S. Pat. No. 537,431 discloses a combined writing sheet and advertising device which is secured to the writing sheet and contains the address and date on its top face. Each of the leaflets of advertising are printed on their top surface. In use the leaflets obscure the upper portion of the writing sheet.

U.S. Pat. No. 1,634,712 discloses a combination match book and note pad with the note pad sheets being bound by a staple within the match book. The interior of the cover includes advertising. The top part of each of note sheets is perforated and the top part which is permanently bound includes advertising.

U.S. Pat. No. 2,755,576 discloses an advertising display pad which includes a backing sheet and a signature tab on the back of the backing sheet with pressure sensitive tape on the back surface of the signature tab. The sheets of the pad are bound together and to the backing by a strip on their upper edges.

U.S. Pat. No. 2,797,509 discloses an advertising display combination of a sign having a slit which receives a pad to be inserted therein. The pad has an upper extension with a pressure sensitive adhesive backing. The pad and its backing are bound with a gummed gauze along their upper edges.

U.S. Pat. No. 4,395,056 discloses a note booklet including a multiple sheet pad and a cover secured to the pad and having multiple fold lines which allow folding of the cover into a structure suitable for holding a pen and also to house note sheets.

SUMMARY

The present invention relates to an improved note pad having a stack of note sheets bound together with a structure which is bound with the sheets on their top surface so that it can fold up to allow full use of each sheet and such structure includes advertising on its upper face after it has been folded up from the sheets. In one form such structure is a business card bound face down on the pad and in another form such structure is a plastic pocket which is sized to receive business cards therein to be visible when above the sheets. In still another form an advertising card is bound with the pad between the top sheet and the top structure which card is suitable for removal and use in the roller type of telephone index files.

an object of the present invention is to provide an improved note pad with fold-back advertising bound thereto so that all of each sheet may be used.

Another object is to provide an improved note pad with a business car bound thereto to fold back exposing all of the tap sheet of the pad.

A further object is to provide an improved note pad with a transparent card holder bound to the top of the pad and movable away from the top of the pad to expose complete sheets and the lower surface of the holder.

Still another object is to provide an improved note pad with an advertising card bound on top of the stack of pad sheets for removal and a fold back advertising bound above the advertising card.

BRIEF DESCRIPTION OF THE DRAWINGS

These and other objects and advantages of the present invention are hereinafter set forth and explained with reference to the drawings wherein.

DESCRIPTION OF THE PREFERRED EMBODIMENTS

Figure 1:
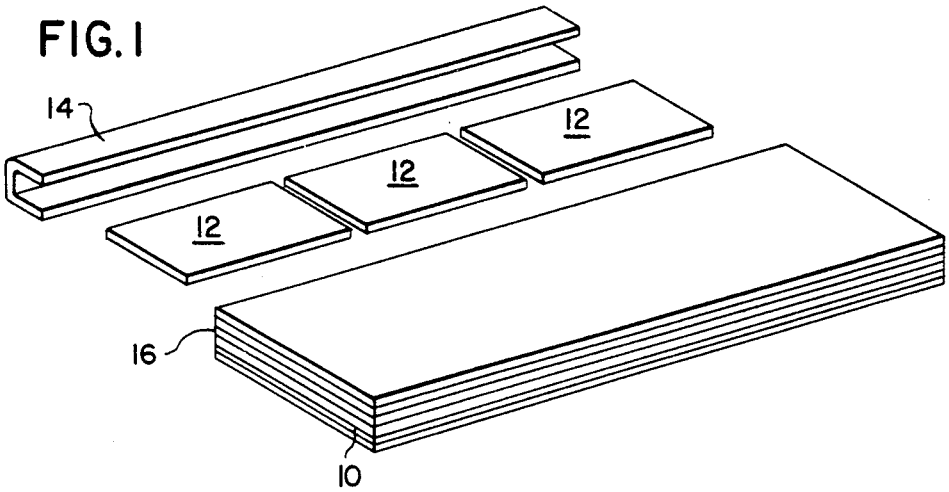
FIG. 1 is an exploded view of the components of a multiple pad stack of sheets, a plurality of advertising cards and suitable binding.
Figure 2:
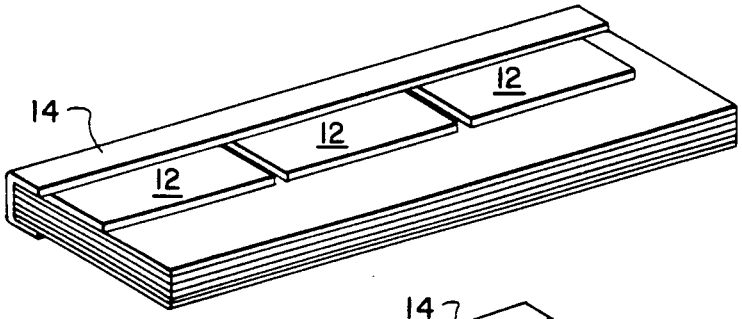
FIG. 2 is an isometric view of a complete multiple pad which has been bound from the components illustrated in FIG. 1.

As shown in FIG. 1, stack 10 of sheets of paper suitable for note pads which, for example, may have a width of eight and one-half inches and a length of five and three-quarters inches (one-half of an eight and one half by eleven sheet) is provided together with a plurality of advertising structures 12, such as three business cards, and binding strip 14. Advertising structures 12 are placed face down on the top surface of stack 10 and in a position across the top edge 16 of stack 10. Binding strip 14 is bound by suitable means to the bottom surface adjacent top edge 16 of stack 10, to the top edges of each of the sheets and to the top surface of each of advertising structures 12. Care is taken in the binding step so that binding string 14 is not bound to the top surface of stack 10 or if it does become bound to the top surface between the advertising structures 12, then the step of cutting the intermediate structure formed by the binding and shown in FIG. 2 is performed along the edges of advertising structures 12 so that no portion of binding strip 14 is bound to the top surface of the top sheet of stack 10. Failure to avoid this binding will result in the production of a pad on which the advertising structure 12 is not foldable away from the upper surface of stack 10.

Figure 3:
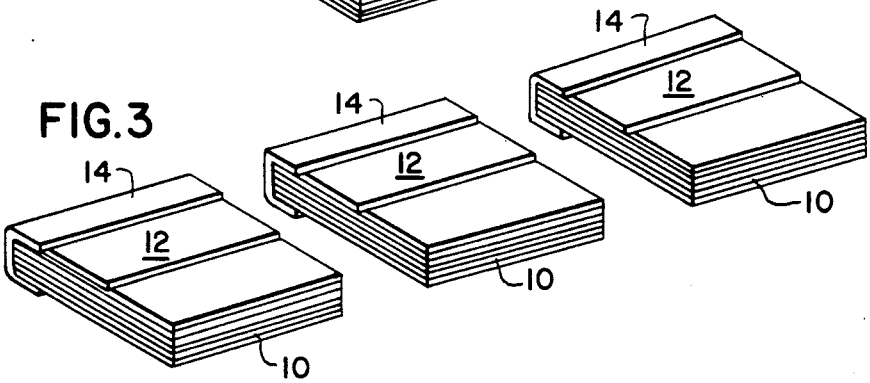
FIG. 3 illustrates the individual note pads made from the pad illustrated in FIG. 2 after they have been cut and trimmed.
Figure 4:
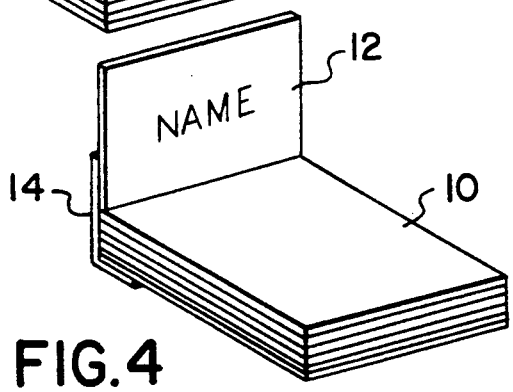
FIG. 4 is an isometric view of a note pad of the present invention with a business card bound therewith.

Generally in the preparation of the improved note pads of the present invention, advertising structures may be the usual business cards of the person who will receive the improved note pads 18 as shown in FIGS. 3 and 4. Any special advertising card may be used as the advertising structure 12 of the present invention.

Figure 5:
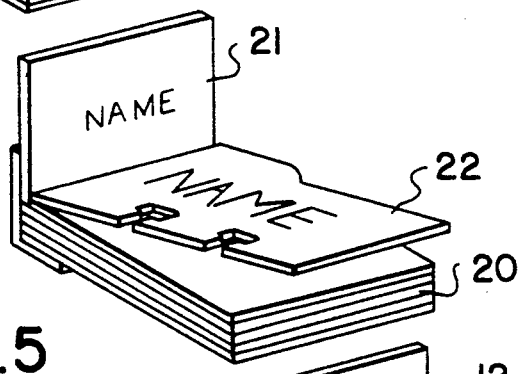
FIG. 5 is an isometric view of a note pad with a business card bond thereto and with a roller file card bound on top of the sheets in the stack.

As shown in FIG. 5, an additional advertising card is removably bound into the top of the pad 20 in without displacing advertising structure 21. This is a telephone listing advertising card 22 which is normally used in a roller type of telephone directory device. Telephone card 22 is suitable to be removed from the top of note pad 20 and placed in the telephone directory device to allow use of the top sheet in note pad 20.

Figure 6:
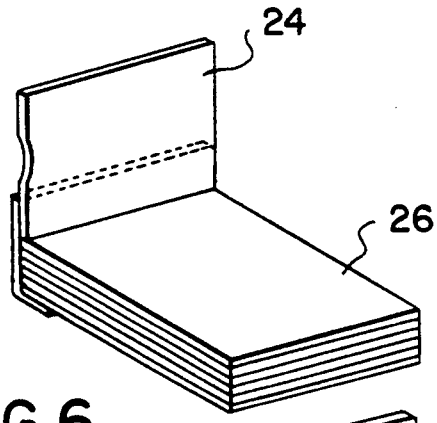
FIG. 6 is another similar view in which the advertising structure bound into the pad is a transparent card case.

Another form of the present invention is shown in FIG. 6 wherein the advertising structure is a transparent pocket 24 which is bound on the top of note pad 26 and may be folded back to expose all of the top sheet of note pad 26. Since pocket 24 is transparent, one or more business cards or other advertising cards may be inserted therein with one being visible and readable when pocket 24 is folded back away from the top of pad 26. The second card used with pocket 24 should be visible and readable from the top of pocket 24 before it is folded back from note pad 26.

It is contemplated that each sheet of the stack in the note pads of the present invention may have a light adhesive along its back surface near the top edge of the sheet. With such structure, the individual sheet, after it has been used, may be affixed to some object if desired.

From the foregoing it can be seen that the present invention provides an improved structure for note pads allowing the use of advertising structures which do not interfere with the use of the complete surface of each sheet in the pad. Such improved note pad is believed to be a convenient pad structure and useful to place advertising material in the hands of potential customers in a form which will be appreciated by the customer.

What is claimed is:

1. A note pad comprising a stack of sheets of note paper having binding edges and a top surface, a flat advertising structure having an upper surface, a lower surface with advertising on the lower surface and a binding edge, and binding means engaging the binding edges of the sheets and the upper surface of the advertising structure said binding means being sufficiently flexible to allow said structure to pivot away from the sheets exposing all of the top surface of the top sheet.

2. A note pad according to claim 1 wherein said advertising structure is a business card bound face down on the top of the stack of sheets of note paper.

3. A note pad according to claim 1 wherein said advertising structure is a transparent pocket which is open along one edge to receive an advertising card.

4. A note pad according to claim 1 including an advertising card designed for use in a roller file bound to the top of the stack of papers immediately below said advertising structure.

5. A multiple note pad structure comprising a stack of note sheets having a width equal to the desired length of individual note pads and a length at least equal to a multiple of the desired width of the note pad, said stack having a top surface and a binding edge, a plurality of advertising structures each of said structures having an upper surface, a lower surface on which advertising material is included thereon and a binding edge, and means for binding the edges of the note sheets and the advertising structures on the top surface of the note sheets and in covering relationship to the portion of the top of said note sheets along its bound edge.

6. A structure according to claim 5 wherein the sheets between the advertising structures are cut to provide a plurality of note pads with each note pad having a separate and complete advertising structure bound on its top surface and along the bound edges of the note sheets.

* * * * *